United States Patent [19]

Roeder

[11] 4,026,661

[45] May 31, 1977

[54] HYDRAULICALLY OPERATED SUCKER ROD PUMPING SYSTEM

[76] Inventor: George K. Roeder, Box 4335, Odessa, Tex. 79760

[22] Filed: Jan. 29, 1976

[21] Appl. No.: 653,284

[52] U.S. Cl. ..... 417/53; 417/260; 417/374; 417/383; 417/401; 60/560; 60/565

[51] Int. Cl.[2] ..... F04B 17/00; F04B 35/02; F15B 7/00; B60T 17/00

[58] Field of Search ..... 60/533, 560, 558, 565; 417/383, 398, 401, 260, 374, 53; 92/13.1, 13.3; 91/460

[56] References Cited

UNITED STATES PATENTS

| | | | |
|---|---|---|---|
| 1,230,219 | 6/1917 | Reall | 417/374 |
| 2,453,350 | 11/1948 | Stegeman | 60/565 |
| 2,684,639 | 7/1954 | Sutton | 417/260 |
| 3,096,717 | 7/1963 | Roeder | 417/388 |
| 3,376,826 | 4/1968 | Crowe | 92/84 |
| 3,782,123 | 1/1974 | Muschalek | 60/533 |

*Primary Examiner*—Carlton R. Croyle
*Assistant Examiner*—Thomas I. Ross
*Attorney, Agent, or Firm*—Marcus L. Bates

[57] ABSTRACT

The method and apparatus for producing an oil well, by the provision of a pumpjack unit which reciprocates an engine assembly located within the upper extremity of a wellbore. The engine assembly has a power piston which hydraulically drives a lift piston by means of hydraulic fluid being transferred therebetween. The lift piston is directly attached to and reciprocates a string of sucker rod, which in turn reciprocates the downhole production pump.

The hydraulic fluid associated with the engine assembly is contained within a closed system, and the relative sizes of the power and lift pistons are of a ratio to cause the lift piston to travel a greater distance respective to the power piston, thereby enabling a relatively short stroke of the polish rod to impart the piston of the subsurface pump with a relatively larger stroke.

13 Claims, 5 Drawing Figures

HYDRAULICALLY OPERATED SUCKER ROD PUMPING SYSTEM

BACKGROUND OF THE INVENTION

The demand for increased oil production has brought about a need for a longer stroking pumping unit. Where this need is accomplished by a pumpjack unit, the cost of such longer stroking pumping units is exhorbitant because the pumpjack unit must necessarily be of gigantic proportions in order that a long rocking beam be sufficiently elevated into the air by the Sampson post such that the polish rod reciprocates a considerable distance to thereby impart a long stroke into a subsurface pump.

In my previously issued U.S. Pat No. 3,096,717, issued July 9, 1963, there is taught improvements in a well pump of which a sucker rod stroke of a given length is caused to move a pumping piston through a much longer stroke to thereby achieve the benefits of long stroke pump operation, while utilizing a relatively short sucker rod stroke. In this particular hydraulically operated pump apparatus, the arrangement of the engine respective to the subsurface pump results in insufficient tension being effected within the sucker rod string during the downstroke cycle. This type of system induces rod breakage because of accumulation of gaseous fluid under the lift piston of the engine. The gaseous hydrocarbons separate from the production fluid and enter under the lift piston or the power piston, thereby preventing an optimum stroke to be imparted into the subsurface pump. This condition promotes rod breaks, as well as accelerated wear of the various other moving parts. It also greatly reduces pumping efficiency, and in its most aggravated form, harmonic motion may be induced within the rod string which causes various components of the system to get out of phase with one another, ultimately causing failure of the components thereof.

Accordingly, it is desirable to provide a downhole hydraulically actuated pump assembly, which is operated in conjunction with a pumpjack unit, and wherein the entire pumping unit, except for the pumpjack, is located within the borehole. This desirable expedient prevents contamination of the surrounding geographical location with crude oil, should any leaks develop therein. It is also desirable to provide a low cost, longer stroking pump unit which provides a greater subsurface pump stroke with respect to the stroke of the polish rod. It is further desirable that such a pump maintain the entire sucker rod string in tension during both the upstroke and the downstroke.

SUMMARY OF THE INVENTION

Figure 1:
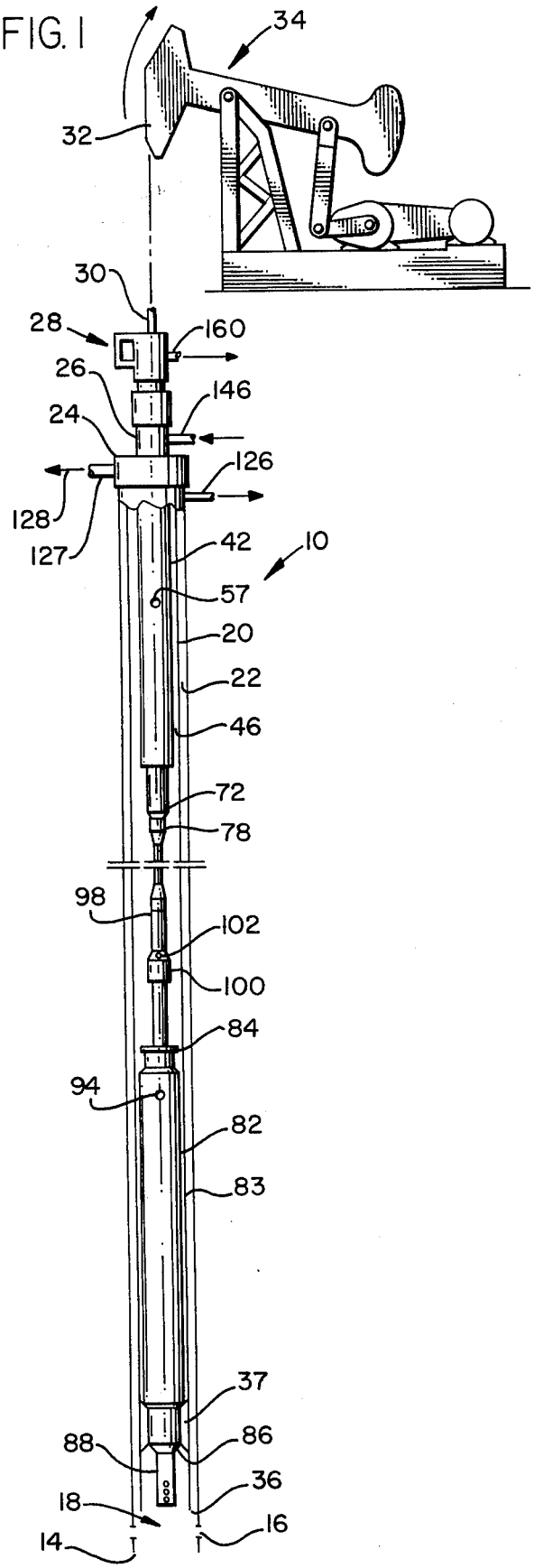
FIG. 1 is a part diagrammatical, part schematical representation of a hydraulically operated sucker rod pumping system made in accordance with the present invention.
Figure 3:
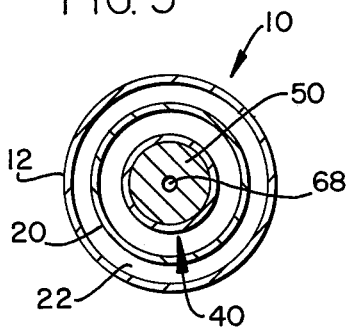
Figure 4:
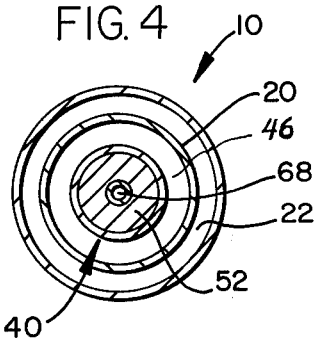
Figure 5:
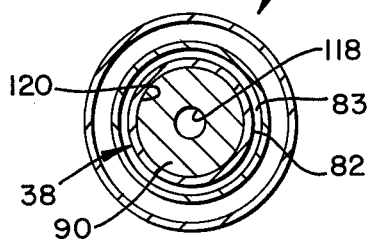

A hydraulically operated sucker rod pumping system for producing fluid from a wellbore. The pumping system includes the combination of a pumpjack unit, an engine, and a subsurface production pump. The engine and subsurface pump are located in spaced relationship within the wellbore and are connected together by a string of sucker rod. The pumpjack unit is located above the surface of the ground and imparts reciprocatory motion into a polish rod in the usual manner.

The engine includes a power piston and lift piston. The polish rod drives the power piston of the engine, which forces hydraulic fluid to flow within a closed loop system. The lift piston underlies the power piston and is reciprocated by the power fluid in response to the action of the power piston. The lift piston is sized respective to the power piston so that it moves a longer stroke respective to the stroke of the power piston.

The lift piston is directly connected to an engine lift rod, and the lift rod is connected to the string of sucker rod which extends downhole into the lower borehole, where the lower end of the sucker rod is connected to and reciprocates the subsurface production pump.

An isolated source of power fluid is contained within a closed system and is continuously replaced as needed above the power piston, where it is pumped or transferred into an annular chamber which underlies the lift piston so that as the power piston upstrokes, the lift piston also upstrokes. Since the effective relative areas of the power and lift pistons are arranged respective to one another so that the lift piston strokes a greater distance respective to the stroke of the power piston, a conventional pumpjack unit can be advantageously employed to stroke the subsurface pump a relatively long distance for a relatively short stroke of the polish rod, thereby obviating the necessity of employing a gigantic pumpjack unit which would otherwise be required to achieve the same desirable result.

Passageway means are arranged within the engine such that as the power piston upstrokes, fluid flows through a hollow engine power rod, through the lift piston, and into the annular chamber within which the lift piston reciprocates, thereby causing the lift piston to reciprocate concurrently with the power piston.

This aspect of the invention, together with the novel design considerations of the subsurface pump, provides a combination which produces the unexpected result of vastly improved pumping efficiency and smoothness operation.

A primary object of this invention is the provision of a hydraulically actuated, long stroking pumping unit which is reciprocated in response to movement of a polish rod associated with a pumpjack.

Another object of the invention is to provide a hydraulically operated well pump having an engine which is actuated by a pumpjack in such a manner that a sucker rod actuated subsurface pump is imparted with a stroke which is considerably longer than the stroke of the polish rod associated with the pumpjack.

A further object of this invention is to disclose and provide a hydraulically actuated subsurface pump and engine which reduces rod breakage by maintaining the sucker rods in tension at all times.

A still further object of this invention is the provision of a subsurface pumping unit having an engine which is driven by a pumpjack unit, and a subsurface pump spaced from the engine and connected thereto by a string of sucker rod, with the engine, sucker rod, and subsurface pump being arranged in such a manner that undesirable harmonic motions are considerably reduced.

Another and still further object of the present invention is to disclose and provide a wiper system for a subsurface pump which prevents debris from contaminating the pump plunger tube seal.

An additional object of the invention is to provide a downhole pumping assembly actuated in response to a pumpjack unit wherein a engine located within a borehole hydraulically drives a string of sucker rod connected to a subsurface production pump in such a manner that the sucker rod drives the subsurface pump with a much greater stroke respective to the stroke of the polish rod, and wherein the sucker rod is reciprocated in such a manner that the rod string is always maintained under tension.

Still another object of this invention is the provision of means by which the ratio of pumping stroke of a polish rod and subsurface pump can be changed relative to one another to achieve a long pump stroke in response to a shorter polish rod stroke.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Throughout the various different figures of the drawings, like or similar numerals will usually refer to like or similar objects or elements. In the various figures of the drawings, there is disclosed the pump device of the present invention, generally indicated by the arrow at numeral 10.

As seen in the drawings, a wellbore is provided with the usual casing 12. A plurality of perforations 16 are formed in the marginal terminal end portion 14 of the casing so that production fluid from a production zone is forced to enter the interior of the casing at 18. A production tubing 20 is concentrically arranged respective to the casing and forms a casing annulus 22 therebetween. A wellhead 24 is connected to the casing and to the production tubing. The production tubing upwardly extends from the wellhead and receives a stuffing box 28 at the upper terminal end thereof. A polish rod 30 sealingly and reciprocatingly extends through the stuffing box and into the interior of the production tubing.

The polish rod is connected to a horsehead 32 by means of the usual bridle so that a pumpjack unit 34 of conventional design can reciprocate the polish rod in the usual manner.

The lower end 36 of the production tubing is disposed below the liquid level of the production fluid contained within the casing annulus, and a seating device 37 removably receives the lower marginal end of a subsurface production pump assembly 38.

A hydraulic engine assembly 40 is concentrically disposed within the upper marginal end portion of the production tubing in spaced relationship to the subsurface pump assembly. The engine includes an engine barrel 42 which terminates at a seal means 44. A production tubing annulus 46 is formed between the engine barrel and the production tubing. The interior of the engine barrel is formed into a piston receiving cylindrical surface 48. Spaced engine pistons reciprocate in sealed relationship respective to the cylindrical surface of the barrel, and are comprised of a power piston 50 and a lift piston 52. The power and lift piston, together with the seals and stuffing box, divide the interior of the engine barrel into an upper piston chamber 54, a central piston chamber 56, and a lower piston chamber 58, with the central piston chamber 56 mutually sharing the power and lift pistons. The power piston is connected to the polish rod by means of a hollow adapter 60. Port 62 is formed within the adapter. A flow passageway 68 extends from port 62, through the power piston, and through a hollow power rod 64. The hollow power rod has an open end as indicated by numeral 66. The power rod isolates the power fluid from the production fluid contained within chamber 56.

A hollow piston seal surface is formed through the lift piston and sealingly engages the exterior surface of the power rod in a reciprocating manner. A hollow engine lift rod 70 is affixed to the lift piston and downwardly extends through the lower marginal end of the engine barrel, where the before mentioned seal 44 sealingly engages the exterior surface of the lift rod in a reciprocating manner. The lower end of the lift rod is closed and formed into an adapter 72, thereby leaving a chamber 74 within which the marginal terminal end of the power rod reciprocatingly extends. Port 76, formed within the lift rod, provides a fluid flow path into the lower annular piston chamber 58.

A sucker rod 80 extends from the lift rod downhole to the before mentioned subsurface pump assembly. The pump assembly includes a production pump barrel 82 which is usually spaced from the lower production tubing to form a production annulus 83. The upper end of the pump is provided with a packing gland at 84, while the lower pump end 86 sealingly engages the seat 37, and additionally is optionally provided with a sand screen 88 which precludes intake of debris therewithin.

The subsurface pump assembly disclosed herein is provided with a hollow piston 90 which reciprocates within the pump barrel. Seal 92 closes the upper end of the barrel, while ports 94 lubricate the plunger tube 96. Hence, the upper packing gland prevents debris from contaminating the seal 92.

The plunger tube is connected to the string of sucker rod by means of a sub 98. The upper extremity of the plunger tube is provided with an exhaust valve cage 100 having a production fluid outlet 102 and a check valve, which includes a ball 104 and a seat 106. The hollow plunger tube has an axial passageway 108 which extends from an intake valve cage 110 uphole to the exhaust valve cage 100. The intake valve cage is provided with a plurality of production fluid inlet ports 112 and a check valve assembly, which includes a ball 114 and a seat 116.

The before mentioned hollow piston of the subsurface pump preferably is provided with an axial passageway 118 through which production fluid can flow uphole towards the intake valve.

The pump barrel has an inside peripheral surface 120 which slidably and sealingly receives the before mentioned piston 90 in a reciprocating manner. Annulus 122 is formed between the wall surface 120 and the exterior of the plunger tube located therewithin. The pump piston therefore divides the pump barrel into an upper annular chamber 122 and a lower cylindrical chamber 124, with the lower chamber being in fluid communication with the fluid inflow at 18 of the casing.

The wellhead is provided with piping 127, which forms a production fluid outlet. Flow line 128 is usually connected to a tank farm or battery for accumulation of produced fluid. Lateral line 130 enables a side stream of produced fluid to flow through a filter means 132, through a control valve 136, and into a reservoir in the form of a holding tank 138, so that clean, filtered oil is available at 140 for the pump 142. Where sufficient hydrostatic head is obtainable, pump 142 need not be included within line 140. The pump moves fluid to pipe connection 144 and to the inlet piping 146, which provides a source of replenishment power fluid for the before mentioned upper chamber of the engine. Valve 148 is connected between fittings 134 and 144 so that pressure regulation can be attained at 146, as well as a bypass feature for pump 142. The control valve 136 preferably is operated in response to a fluid level control 150 which monitors any desired fluid level contained within the holding tank 138. Valve 152 isolates the closed system of the engine from the source of replenishment power fluid.

OPERATION

Figure 2:
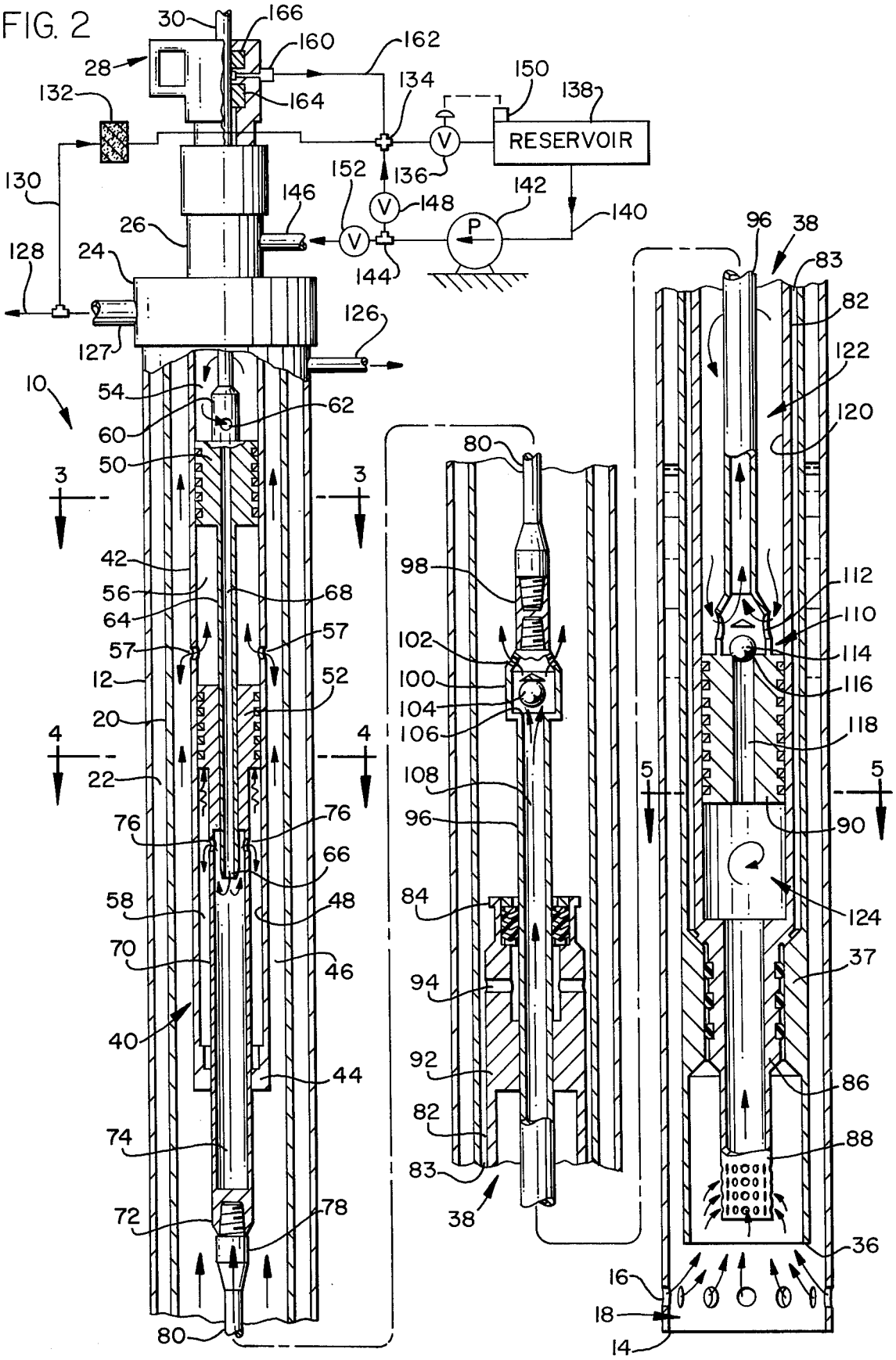
FIG. 2 is a detailed longitudinal, part cross-sectional representation of part of the well pumping apparatus made in accordance with the present invention, and generally disclosed in FIG. 1; and, FIGS. 3, 4, and 5, respectively, are cross-sectional views taken along lines 3—3, 4—4, 5—5, respectively, of FIG. 2.

In operation, the walking beam of the pumpjack unit is rocked by the gearbox, which in turn is driven by whatever prime mover may be employed for the particular well site selected in FIGS. 1 and 2. The polish rod reciprocates within the stuffing box, and reciprocates the power piston. On the upstroke, fluid contained within chamber 54 is forced to flow through port 62, through the power rod 64, where the power fluid flows along an isolated flow path 68 through chamber 56 and through the lift piston where the power fluid exits at 66 into the chamber 74. The flow continues on through radial port 76 and into the lower annular chamber 58. This action forces the lift piston to move in an upward direction, with its movement being proportional to the displacement of the annular chamber 58 and to the displaced fluid from chamber 54. Accordingly, the lift piston travels in an upward direction a much larger or longer or greater stroke as compared to the power piston, because the effective area of the lift piston is considerably smaller than the effective area of the power piston.

The lift piston and the power piston are spaced sufficiently far enough apart such that upon reaching top dead center, the power piston remains spaced from the lift piston, with the ports 57 being located therebetween. The string of sucker rod 80 is lifted by the action of the hollow engine lift rod 70, thereby stroking the subsurface pump assembly 38 in an upward direction.

On the downstroke of the polish rod, the power piston moves downhole, thereby causing the upper chamber 54 to increase in volume. Consequently, fluid must flow from the lower annular chamber 58, back through the radial port 76, into the lift rod chamber 74, where fluid flows into the hollow engine power rod and uphole into the upper chamber 54 by means of port 62. This action, together with the hydrostatic head effected upon the lift piston, causes both the power and lift piston to travel downhole to their lowermost position, with the lift piston traveling a greater stroke respective to the power piston, dependent upon the aforesaid differences in piston area. The power piston stops short of ports 57, while the lift piston must stop short of seal 44. Furthermore, the length of the power rod respective to the travel of the power and lift pistons is such that a marginal end portion at 66 is always received within the axial passageway of piston 52.

As the lift rod causes the sucker rod to stroke down, production fluid at 124 flows through passageway 118, through the intake valve 110, and into the annular chamber 122 of the pump. During this phase of the operation, the exhaust valve assembly is seated; and accordingly, chamber 122 is filled with formation fluid. As the sucker rod upstrokes, the intake valve is seated, and production fluid flows from annular chamber 122, through ports 112, uphole through the axial passageway 108 of the plunger tube, through the seat 106, through ports 102, uphole through the production tube, up through annular passageway 46, to the wellhead, and out of piping 127, where the produced fluid flows on to the tank battery.

In the present invention, during the upstroke, the pumpjack unit lifts the power piston, thereby forcing fluid to flow into the lower annular engine chamber 58, whereupon the lift piston moves in an upward direction. Since the lift piston is connected to the sucker rods, the upward movement causes the exhaust valve and plunger tube to move upwards. During this time, the intake valve assumes a closed configuration, and the fluid within the pump chamber 122 is lifted against the entire hydrostatic head.

During the downstroke, the movement of the subsurface pump piston is brought about by the various hydrostatic heads involved, as well as the weight of the pump piston, plunger tube, sucker rod system, lift rod, and lift piston. The hydrostatic heads involved at the engine are relatively small and is comprised of the hydrostatic pressure effected within the central chamber 56 acting upon the upper annular surface of piston 52. The downhole hydrostatic pressure is effected upon the exhaust valve assembly and forces the exhaust ball onto its seat and applies its weight to the sucker rods, thereby keeping the rod string in tension as the fluid weight forces the plunger tube of the subsurface pump in a downward direction. This downward force continues until the pumping unit begins its upward stroke, whereupon the before described events then take place in a cyclic manner.

The present invention provides a means by which the need of a longer stroking downhole pump unit can be satisfied with a minimum of investment. The longer stroking pumping unit of the present invention provides greater over travel during the downstroke by maintaining the sucker rods in proper tension, which reduces wear on the downhole equipment, and more importantly, eliminates rod parting and loss of production, such as found in many analogous prior art pump apparatus.

In FIG. 2, the upper chamber 54 can be directly connected to the reservoir 138 and clean hydraulic fluid stored therein so that there is always an ample supply of fluid available for replenishing any fluid which may be used over an extended period of operation. In this instance, the pump 142 can be elminated, and the vessel can be pressurized, if desired. Alternatively, a valve 152 can be installed within the inflow pipe 146 leading into the upper chamber 54, so that the unit can be serviced from time to time by pumping oil into the intake 146 as may be desired.

I claim:

1. A well pump assembly for location within a borehole, said pump assembly having an engine and a production pump arranged in concentric spaced relationship respective to one another with said production pump underlying said engine, said engine having a working barrel, a power piston, a lift piston, a hollow engine power rod, a hollow engine lift rod, and means by which said power piston can be connected to a polish rod of a pumpjack unit, said lift piston and said power piston being reciprocatingly received within said working barrel, and dividing said working barrel into an upper, central, and lower chamber; said hollow engine power rod being connected to said power piston and having a marginal length thereof reciprocatingly received in sealed relationship through said lift piston with a marginal end portion thereof extending into said lift rod, said lift rod having an upper end thereof affixed to said lift piston and a marginal length thereof extending through said lower chamber, seal means by which one end of said working barrel sealingly engages the exterior surface of said lift rod;

means forming an isolated fluid flow path which connects said upper chamber to said lower chamber;

a string of sucker rods; and means by which said production pump and a lower end of said lift rod are connected together by said string of sucker rods.

2. The well pump assembly of claim 1 wherein means are provided by which said central chamber is subjected to the hydrostatic head of any fluid which may be present adjacent to said working barrel.

3. The well pump assembly of claim 1 wherein said isolated fluid flow path is a passageway which extends from said upper chamber, through said power piston, through said hollow rod, through said lift piston, into said hollow lift rod, and into said lower chamber so that movement of said power piston causes fluid to flow between said upper and lower chambers to thereby cause movement of said lift piston.

4. The well pump assembly of claim 1 wherein said production pump includes a pump barrel, a pump piston, an intake valve assembly, an exhaust valve assembly;

a hollow plunger tube connected to said pump piston and to said string of sucker rod, said exhaust valve assembly being located between said sucker rod and said plunger tube, said intake valve assembly being located between said pump piston and plunger tube; means forming a flow path through said pump piston to said intake valve, from said intake valve into said hollow plunger tube, and from the last named tube to said exhaust valve.

5. The well pump assembly of claim 1 wherein means are provided by which said central chamber is subjected to the hydrostatic head of any fluid which may be present adjacent to said working barrel;

said isolated fluid flow path is a passageway which extends from said upper chamber, through said power piston, through said hollow rod, through said lift piston, into said hollow lift rod, and into said lower chamber so that movement of said power piston causes fluid to flow between said upper and lower chambers to thereby cause movement of said lift piston;

said production pump includes a pump barrel, a pump piston, and intake valve assembly, an exhaust valve assembly;

a hollow plunger tube connected to said pump piston and to said string of sucker rod, said exhaust valve assembly being located between said sucker rod and said plunger tube, said intake valve assembly being located between said pump piston and plunger tube; means forming a flow path through said pump piston to said intake valve, from said intake valve into said hollow plunger tube, and from the last named tube to said exhaust valve.

6. In a hydraulically operated sucker rod pumping system comprising a pumpjack unit having a polish rod extending into a borehole, an engine assembly located in the upper extremity of the borehole and connected to be actuated by said polish rod, a subsurface pump located in the lower extremity of the borehole and below the liquid level of formation fluid to be produced, and a string of sucker rod connected between said engine and said subsurface pump such that the rod string is reciprocated by the engine, the improvement comprising:

said engine having a barrel, a power piston and a lift piston spaced from one another and reciprocatingly received in slidable sealed relationship within said barrel such that the pistons are movable independently of one another;

means connecting said power piston directly to the polish rod, a hollow power rod extending downward from said power piston; said lift piston having an axial bore formed therethrough with said bore sealingly receiving a marginal length of said power rod in a reciprocating manner;

a hollow lift rod connected to said lift piston and extending downwards therefrom;

a seal at the lower end of said engine barrel, a stuffing box at the upper end of said barrel; said polish rod having a marginal length thereof sealingly received by said stuffing box, said lift rod having a marginal length thereof sealingly received by said seal; said pistons dividing said engine barrel into an upper chamber, a central chamber, and a lower chamber;

means forming a fluid flow path from said upper chamber, through said power piston, through said power rod, through said lift piston, and into said lower chamber such that when said upper, central, and lower chambers are filled with fluid, reciprocation of the power piston causes said lift piston to reciprocate concurrently therewith;

a lower end of said lift rod being connected to said sucker rod string so that reciprocation of said pumpjack unit imparts reciprocatory motion into said power piston which causes said lift piston to reciprocate the subsurface pump by means of the rod string and lift rod.

7. The improvement of claim 6 wherein means are provided by which said central chamber is subjected to the hydrostatic head of any fluid which may be present adjacent to said working barrel.

8. The improvement of claim 6 wherein said production pump includes a pump barrel, a pump piston, an intake valve assembly, an exhaust valve assembly;

a hollow plunger tube connected to said pump piston and to said string of sucker rod, said exhaust valve assembly being located between said sucker rod and said plunger tube, said intake valve assembly being located between said pump piston and plunger tube; means forming a flow path through said pump piston to said intake valve, from said intake valve into said hollow plunger tube, and from the last named tube to said exhaust valve.

9. The improvement of claim 6 wherein means are provided by which said central chamber is subjected to the hydrostatic head of any fluid which may be present adjacent to said working barrel;

said isolated flow path is a passageway which extends from said upper chamber, through said power piston, through said hollow rod, through said lift piston, into said hollow lift rod, and into said lower chamber so that movement of said power piston causes fluid to flow between said upper and lower chambers to thereby cause movement of said lift piston;

said production pump includes a pump barrel, a pump piston, an intake valve assembly, an exhaust valve assembly;

a hollow plunger tube connected to said pump piston and to said string of sucker rod, said exhaust valve assembly being located between said sucker rod and said plunger tube, said intake valve assembly being located between said pump piston and plunger tube; means forming a flow path through said pump piston to said intake valve, from said intake valve into said hollow plunger tube, and from the last named tube to said exhaust valve.

10. In a wellbore having a subsurface pump actuated by a string of sucker rod, and further having a pumpjack unit which reciprocates a polish rod, the method of producing the well comprising the steps of:

dividing a cylindrical chamber into three spaced axially aligned chambers by placing a power piston and a lift piston both independently reciprocable in spaced relationship within the cylindrical chamber;

connecting said polish rod to said upper piston and sealingly engaging said polish rod at the upper end of said upper chamber;

connecting said lift piston to said string of sucker rod by means of a hollow lift rod, and sealingly engaging the lift rod at the lower end of said lower chamber;

connecting a hollow engine power rod to said power piston and slidably receiving the power rod in a reciprocating and sealed manner by said lift piston;

forming an isolated fluid flow path from the uppermost to the lowermost of said three chambers by the provision of a flow path which extends through the power piston, through said power rod, into said lift rod, and into said lower chamber; whereby, movement of said polish rod imparts reciprocal movement into said subsurface pump.

11. The method of claim 10 and further including the step of making the lift piston smaller in effective cross-sectional area respective to said power piston so that a relatively short stroke of the polish rod imparts a relatively long stroke into the string of sucker rod.

12. The method of claim 10 and further including the step of making an axial passageway through the piston and plunger tube of the subsurface pump, connecting the piston chamber to the interior of the plunger tube, placing an intake valve assembly relative to the piston passageway to preclude downhole flow of fluid therethrough, placing an exhaust valve assembly respective to the plunger tube outlet to preclude downhole flow of fluid therethrough; so that the sucker rod string is always under tension while the pump is producing fluid.

13. The method of claim 10 and further including the step of making the lift piston smaller in effective cross-sectional area respective to said power piston so that a relatively short stroke of the polish rod imparts a relatively long stroke into the string of sucker rod;

making an axial passageway through the piston and plunger tube of the subsurface pump, connecting the piston chamber to the interior of the plunger tube, placing an intake valve assembly relative to the piston passageway to preclude downhole flow of fluid therethrough, placing an exhaust valve assembly respective to the plunger tube outlet to preclude downhole flow of fluid therethrough; so that the sucker rod string is always under tension while the pump is producing fluid.

* * * * *